United States Patent [19]

Rice

[11] 4,390,307

[45] Jun. 28, 1983

[54] PILE-DRIVING APPARATUS

[76] Inventor: Alan R. Rice, 16 Falcon Ter., Wylam, Northumberland, England

[21] Appl. No.: 178,581

[22] Filed: Aug. 15, 1980

[30] Foreign Application Priority Data

Aug. 17, 1979 [GB] United Kingdom ..... 7928769

[51] Int. Cl.[3] ..... E02D 7/06; B25D 11/00; E21B 7/26

[52] U.S. Cl. ..... 405/228; 405/232; 173/117; 175/19

[58] Field of Search ..... 405/229, 232, 228; 173/1, 117, 20; 175/56, 105, 107, 19; 124/3; 310/47, 50; 73/82, 84

[56] References Cited

U.S. PATENT DOCUMENTS 1,600,492 9/1926 Schmidt ..... 175/105 X 2,950,088 8/1960 Scott ..... 173/117 X 2,967,302 1/1961 Loveless ..... 173/117

3,498,388 3/1970 Jovis ..... 73/82 X 3,946,598 3/1976 Towne et al. ..... 73/84 X

FOREIGN PATENT DOCUMENTS 2507676 9/1976 Fed. Rep. of Germany ..... 173/117

*Primary Examiner*—David H. Corbin

*Assistant Examiner*—Nancy J. Pistel

*Attorney, Agent, or Firm*—Brisebois & Kruger

[57] ABSTRACT

The present invention relates to pile-driving apparatus, particularly for under-water use. The pile driver basically comprises a linear induction motor having a tubular stator including a plurality of axially spaced stator coils. The slider or armature of the motor comprises the pile to be driven.

5 Claims, 4 Drawing Figures

PILE-DRIVING APPARATUS

The present invention concerns devices for penetrating the soil, and in particular, though not exclusively, the beds of seas or lakes.

The use of drilling rigs in reaching subterranean oil and gas deposits is of course well known. Another very important aspect of soil penetration is the use of penetrometers for driving shafts into soil or sea beds for the purpose of takeing cores, driving piles or determining bearing characteristics for foundations of structures such as oil rig platforms. It will be appreciated that drilling sea beds in virtually any depth of water is a difficult operation and the difficulties are multiplied many times when drilling under such adverse conditions as can be found in, for example, the North Sea.

Present coring or pile driving devices depend on impulse mechanisms in which much of the impulse energy is wasted, in which driving momentum is lost, and recovery allowed between blows in the medium being penetrated.

Furthermore, present methods have difficulty in controlling penetration rates on which resistance is dependent, hence their efficiency cannot be maximised. The control of penetration rates is extremely important in penetrometer measurements of the bearing properties of soils.

Accordingly, the present invention has for an object to provide an extremely simple and rugged drilling apparatus, the penetration rate of which is readily controllable.

Thus, the present invention consists in apparatus for driving piles into soil comprising a linear electric motor consisting of a stator and a slider, the slider comprising a pile to be driven into the soil.

Figure 1A:
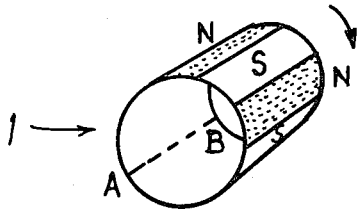
Figure 1B:
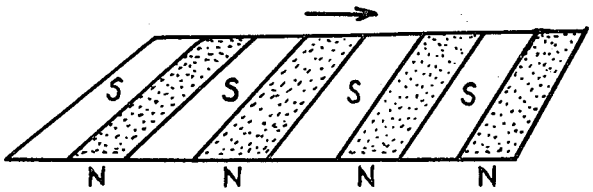
Figure 1C:
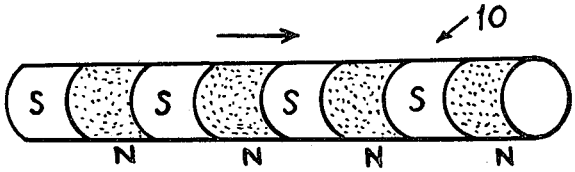
Figure 2:
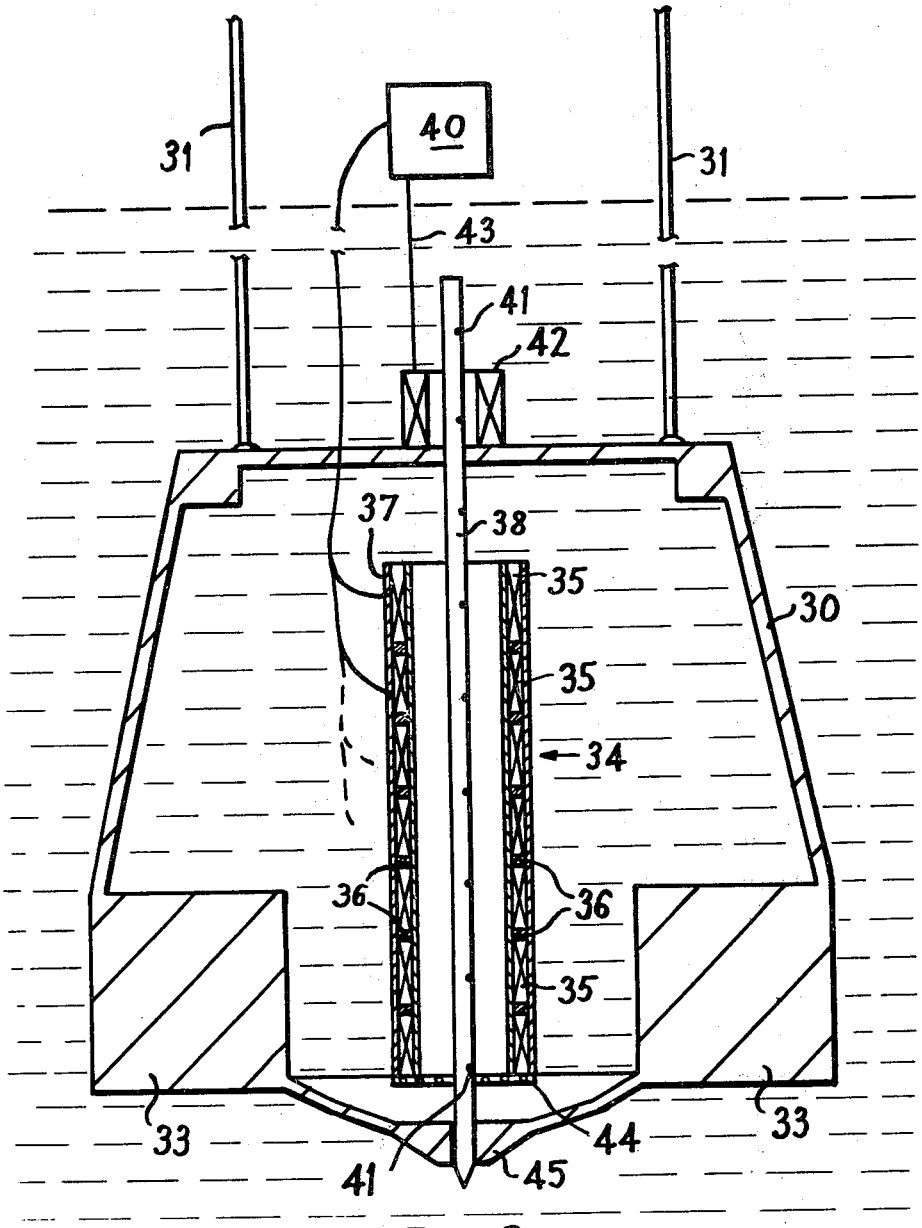

In order that the present invention may be more readily understood, an embodiment thereof will now be described by way of example and with reference to the accompanying drawings, in which:

FIGS. 1*a*, 1*b* and 1*c* are explanatory diagrams relating to the basic principles of linear induction motors (LIM), and FIG. 2 is a diagrammatic view of pile driving apparatus constructed in accordance with the present invention.

Referring now to the accompanying drawings FIGS. 1*a*, 1*b* and 1*c* show diagrammatically the relationship between a rotary induction motor and a linear induction motor, as the operation of a linear induction motor is electrically similar to that of a rotary induction motor.

Thus FIG. 1*a* shows the stator 1 of a rotary induction motor with the alternate North and South poles of the motor marked N and S. FIG. 1*b* shows the stator 1 cut along the line A–B and rolled flat, and FIG. 1*c* shows the flattened stator 1 rolled about an axis orthogonal to its original axis to provide the stator 10 of the linear induction motor. In order to drive the linear motor, a suitable power source utilising, for example, a three-phase winding is used to activate the coils to create a travelling magnetic field running from one end to the other down the interior of the stator tube. This travelling field induces electrical currents in a slider, runner or rod of ferromagnetic material located coaxially in the tube. These induced currents set up their own magnetic field which interacts with that provided by the stator, imposing a force on the rod which attempts to follow the travelling magnetic wave down the tube.

FIG. 2 shows the application of the basic principle discussed above to a penetrometer for use on sea beds.

The penetrometer comprises a metal frame 30 which is, in operation, suspended from a suitably equipped vessel or rig by hawsers 31.

The frame 30 is weighted at 33 to provide the reaction weight to the thrust generated when a pile is driven into the sea bed.

The thrust is generated by a stator 34 comprising a plurality of solenoids or coils 35 stacked verrically, each coil being separated at 36 by magnetically permeable material, and the stacked coils being encased in a magnetic flux guide 37. The coils may be made from Luconex (RTD) heat-resistant enamelled copper strip. The slider comprises a pile 38 which is to be driven, and runs vertically through the stator 34. The pile 38 is a steel rod which may be provided with copper sheathing and which may also be hollow.

A three-phase power supply and its associated control circuit for the LIM is carried on the vessel from which the penetrometer is suspended. The power supply and control is diagrammatically indicated at 40, and as will be apparent from the following will be a low frequency supply. This is because of the important characteristics of LIM's. There is a general set of machine equations employed to describe these characteristics, but these are well known and will not be considered here. In order to be applicable as a penetrometer a LIM operating at a low frequency with large slip will be considered.

Slip is defined as $$s=(V_{syn}-V_{rod}/V_{syn}) \quad (1)$$

where $V_{syn}$ is the velocity down the stator of the travelling magnetic wave and $V_{rod}$ is the velocity of the pile following down the tube in response to the travelling magnetic wave. The magnetic wave sweeps lines of magnetic force through the pile. As this wave moves down the stator, it induces currents in the pile and produces from the pile a magnetic field. The magnetic force on the pile is related to the magnitude of the currents induced in the pile by the travelling magnetic wave. The magnitude of these currents depends on the rate at which the magnetic lines of force sweep through the pile. As the speed of pile approaches that of $V_{syn}$, the rate of change of lines of magnetic force falls off, hence so does the force on the pile. Therefore maximum thrust is obtained at high slip S.

The speed of the pile, as well as its thrust, is an additional design specification. As previously mentioned it is important to control speed. Speed is given by the equation $$V_{rod}=V_{syn}(1-s) \quad (2)$$

where $$V_{syn}=2f\lambda \quad (3)$$

f is frequency and λ is pole pitch.

For extremely slow speed as would be required for penetrometers, the above relation implies the pole pitch be as small as practical. This parameter is then fixed by machine geometry. The thrust, hence the slip, is dependent on voltage for fixed geometry. Voltage is more difficult to control than frequency. In addition the ratio of mechanical power $P_m$ to power $P_r$ applied to the pile is given by $$P_r/P_m \sim 1/(1-s) \quad (4)$$

Attempting to vary slip to control velocity in maximum thrust conditions (e.g., close to 1) will cause large variations in power. Speed control in the present embodiment is thus managed through frequency control which can be obtained with satisfactory accuracy, even at low frequencies wherein phase angle can be monitored.

In order to measure the speed of the pile, and thus its rate of penetration, a plurality of rivets 41 are mounted in the pile at regularly spaced intervals. These rivets 41 change the local reluctance of the rod and these changes are detected by a C-core 42 through which the rod also passes. The windings of the C-core 42 are capable of detecting variations in the local reluctance of the pile regardless of the interposing medium, e.g. sea water, or the surface condition of the rod with respect to dirt or corrosion. The local rate of variation in reluctance as measured by the C-core 42 is directly related to the speed of the rod and is returned via a feedback control loop 43 to the power supply and control 40. It is to be noted that rates of change and not actual values of reluctance are monitored, hence degradation through wear of the rivets does not adversely effect the information they give.

All known linear induction motors to date have been designed to meet demands for high speed runners (rods) so that any section of these runners will spend very little time within the confines of the stator coils. Thus high speed runners pass through this heat generating section quickly and out into ambient temperatures before much heating of the runner has taken place. However, for pile driving or drilling purposes the linear induction motor being described is to operate close to standstill conditions. There are thus two severe disadvantages with regard to heat generation. Any section of the runner within the stator remains within the stator for a considerable duration, e.g. traversing a stator of 1 m. in length at 1 cm/sec. implies a transit time of any section of the runner in the heat generating zone of ~ 100 sec or ~ 1.7 min. This is to be compared to transit times of less than a second for marketed LIMS. Secondly, motor efficiency falls off rapidly near standstill operation, being of the order of any several percent for thrusts of interest here if the motor is driven at 50 hz. As discussed before, since induced losses in the runner are proportional to $f^2$, excessive power losses in the runner may be decreased considerably by employing lower supply frequencies. However, at mains frequency, an efficiency of only several percent implies heat generation of the runner of ~100 Kw if the mechanical power is of the order of 1 Kw. (approximately 10 tons at a cm./sec.). For small diameter radii, say 2.4 in., this represents a high power density, the removal of which (before melting or mechanical failure of the runner occurs) poses some technical concern.

It has been discovered that this heating problem can be adequately met provided that a constant air-gap is maintained between the inner wall of the stator 34 and the pile being driven by the stator. Naturally, in the underwater conditions with which the present invention is particularly concerned, this "air-gap" will actually be filled with water. In fact, boiling of water in this air-gap will materially assist in removing unwanted heat. In order to ensure this gap does not become fouled with debris, the lower end of the stator 34 is closed by a mesh 44 through which the pile can pass. Furthermore, the stator 34 carries an inverted core catcher indicated at 45 to scrape mud from the pile as it is withdrawn.

The power supply and its control circuit 40 may be arranged to allow a variety of modes of operation. Thus, it may generate an internally variable field gradient within the stator, each coil may be energised in turn in series to act as a solenoid, or the stator may be driven as a polyphase tubular induction motor.

In the solenoid modes of operation, the pile should be of relatively high magnetic permeability material. In the tubular motor mode, the pile may be of low permeability with a high conductive skin to act as an inductance driven secondary.

It will be appreciated that the embodiment just described has the great advantage in that it has only one moving part, namely the pile 38. It will also be appreciated that, as in a drilling operation, it is also possible to add additional lengths of pile as the pile is driven into the soil.

The apparatus hereinbefore described may be employed to drive and/or extract piles, or for the purposes of taking soil samples or cores, or for drilling, and it is to be understood that the references to piles and to driving in the specification and appended claims are to be construed as encompassing all such alternatives.

When the apparatus is not used in an under-water environment, cooling of the LIM may be enhanced by the provision of a water jacket by means of which cooling water will be supplied at least to the air-gap between the stator and pile or equivalent.

I claim:

1. In a non-percussive device for driving elements into soil, the improvement comprising:

(a) a linear electric motor including:

i. a motor stator comprising a stator tube provided by a plurality of coaxially arranged coils, the stator tube having a passage extending coaxially therethrough; and ii. a motor slider, the slider itself comprising a non-percussive, non-reciprocating elongate soil penetrator element responsive to electromagnetic energy, said penetrator element, in operation of the device, extending through said passage with a clearance between the outer wall of said element and the inner wall of said stator tube which defines said passage and being slidable axially relative to said stator tube; and (b) continuous axially-unidirectional force-generating means for generating a magnetic wave which travels along the coils of said stator tube, undirectionally, from one end thereof to the other, for inducing electrical currents in said coil penetrator element so as to set up a magnetic field which interacts with the field of said stator tube and imparts directly to said soil penetrator element a continuous, unidirectional driving force to slidably progressively displace said penetrator element through the stator tube in one axial direction only.

2. The device of claim 1, wherein the coils of the stator tube are separated by magnetically permeable material, and a magnetic flux guide encasing said coils.

3. The device of claim 1 including means to energize the motor stator at a relatively low frequency not greater than about 50 hz.

4. The device of claim 1, further comprising speed-detecting means for measuring the rate of said continuous movement of said soil penetrometer element relative to said stator tube, and wherein the speed-detecting means comprises a plurality of regularly spaced elements on said soil penetrometer element to cause local variations in the reluctance of the soil penetrometer element, and means for detecting said local variations in reluctance.

5. The device of claim 1 which comprises underwater pile driving apparatus, and includes means to mount the apparatus from a vessel or rig.

* * * * *